US008356489B2

(12) United States Patent
Lifson et al.

(10) Patent No.: US 8,356,489 B2
(45) Date of Patent: Jan. 22, 2013

(54) INJECTION OF REFRIGERANT IN SYSTEM WITH EXPANDER

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 806 days.

(21) Appl. No.: 12/515,443

(22) PCT Filed: Dec. 26, 2006

(86) PCT No.: PCT/US2006/049201

§ 371 (c)(1), (2), (4) Date: May 19, 2009

(87) PCT Pub. No.: WO2008/079123

PCT Pub. Date: Jul. 3, 2008

(65) Prior Publication Data

US 2010/0058783 A1 Mar. 11, 2010

(51) Int. Cl.

| | |
|---|---|
| ***F25B 1/00*** | (2006.01) |
| ***F25B 1/10*** | (2006.01) |
| ***F25D 9/00*** | (2006.01) |

(52) U.S. Cl. ..... 62/115; 62/510; 62/402

(58) Field of Classification Search ..... 62/115, 62/510, 402, 498

See application file for complete search history.

(56) References Cited

U.S. PATENT DOCUMENTS

| | | | | |
|---|---|---|---|---|
| 5,168,715 | A | 12/1992 | Nakao et al. | |
| 6,499,305 | B2 | 12/2002 | Pham et al. | |
| 6,898,941 | B2 * | 5/2005 | Sienel | 62/87 |
| 6,955,058 | B2 | 10/2005 | Taras et al. | |
| 2010/0077777 | A1 * | 4/2010 | Lifson et al. | 62/117 |
| 2010/0083677 | A1 * | 4/2010 | Lifson et al. | 62/115 |

FOREIGN PATENT DOCUMENTS

| | | | |
|---|---|---|---|
| JP | 03105160 A | * | 5/1991 |
| JP | 2006145144 A | * | 6/2006 |

OTHER PUBLICATIONS

Search Report and Written Opinion mailed on Oct. 25, 2007 for PCT/US2006/49201.

International Preliminary Report Dated Jul. 9, 2009.

* cited by examiner

*Primary Examiner* — Chen Wen Jiang

(74) *Attorney, Agent, or Firm* — Carlson, Gaskey & Olds, PC

(57) ABSTRACT

A refrigerant system incorporates an expander. At least a portion of refrigerant bypasses an evaporator and is injected into the compression process to cool main refrigerant vapor flow and compressor elements. In disclosed embodiments, the injected refrigerant may be partially expanded in the expander and routed either into the compressor suction or to an intermediate point in the compression process. A valve may control the amount of the injected refrigerant to achieve desired operational characteristics for the refrigerant system.

10 Claims, 1 Drawing Sheet

INJECTION OF REFRIGERANT IN SYSTEM WITH EXPANDER

This application is a United States National Phase application of PCT Application No. PCT/US2006/049201 filed Dec. 26, 2006.

BACKGROUND OF THE INVENTION

This application relates to a refrigerant system that utilizes an expander to provide a more efficient expansion process and to recover at least a portion of energy from this expansion process, and wherein at least partially expanded refrigerant is injected back into the compression process to reduce discharge temperature.

Refrigerant systems utilize a refrigerant that is usually circulated through a closed-loop refrigerant cycle to condition a secondary fluid, such as air, water or glycol solution, to be delivered to a climate controlled environment. Typically, in a basic refrigerant system, a compressor compresses the refrigerant and delivers it to a first heat exchanger, which is a condenser, for subcritical applications, and a gas cooler, for transcritical applications. In the first heat exchanger, heat is rejected from the refrigerant and is absorbed by another secondary fluid, such as ambient air. Refrigerant, from that first heat exchanger, passes through an expansion process, during which its pressure and temperature are reduced. Downstream of the expansion device, a refrigerant passes through a second heat exchanger, or so-called evaporator, and then back to the compressor. In the second heat exchanger, the refrigerant is evaporated and typically superheated, while cooling a secondary fluid to be delivered to a climate controlled environment.

Expansion devices can be of a so-called passive or active type. Passive expansion devices are typically represented by an orifice or a valve. The refrigerant expansion through these devices follows an inefficient isenthalpic thermodynamic process. One option that is known in refrigerant systems is the use of an active expansion device or an expander, which follows more thermodynamically efficient isentropic process and can be a turbine, a piston expander (a free-piston type or a linked-piston type), a scroll expander, a screw expander or any other type expander expanding the refrigerant from a higher pressure to a lower pressure. The expander typically recovers at least portion of energy from the expansion process, and that portion of energy is utilized, at least partially, to drive other components, such as, for example, one of the refrigerant system components, such as a compressor, a fan or a pump. Expanders increase performance (efficiency and capacity) of a refrigerant system by recovering this portion of energy and by utilizing a more thermodynamically efficient isentropic expansion process.

Another feature utilized in refrigerant system designs is the injection of a portion of refrigerant back into the compression process. The refrigerant injected into the compression process is typically a two-phase mixture of vapor and liquid. The liquid-vapor mixture cools the compressor elements as well as the main flow of compressed refrigerant. The cooling of the main refrigerant flow occurs as this cooler two-phase mixture undergoes evaporation and mixing process with the hotter main refrigerant vapor.

The refrigerant injection cooling feature becomes even more important for high-pressure refrigerant systems, and specifically for refrigerant systems operating in a transcritical cycle, such as $CO_2$ refrigerant systems. These refrigerants operate at higher pressures and often higher pressure ratios than formerly used conventional refrigerants, thus promoting higher discharge temperatures. Additionally, in most cases, the transcritical cycle is less efficient than the conventional subcritical cycle, requiring even higher discharge pressures or other means of performance enhancement, such as, for instance, a liquid-suction heat exchanger, both increasing refrigerant discharge temperatures. Specifically, $CO_2$ refrigerant has a higher value of a polytropic exponent (than other conventional refrigerants), also undesirably affecting the discharge temperature. On the other hand, in the transcritical cycle, pressure and temperature are essentially independent from each other, so discharge temperature reduction may find additional benefits of performance optimization, operational envelope extension and reliability improvement.

The use of this injected refrigerant is known in the art, and a worker skilled in this art would recognize when and how much injected refrigerant would be desirable. For instance, the refrigerant may be injected into the compression process to maintain a compressor discharge temperature, to control discharge or suction superheat, etc.

However, a refrigerant system has never been proposed, which has utilized the expander in combination with this refrigerant injection cooling, especially in conjunction with $CO_2$ applications that can operate in a transcritical cycle.

SUMMARY OF THE INVENTION

In the disclosed embodiment of this invention, a refrigerant system incorporates an expander that is utilized to efficiently expand refrigerant from a higher pressure to a lower pressure, and recover at least a portion of energy from that expansion process to assist in driving one of the refrigerant system components. In a disclosed embodiment, the expander assists in driving of at least one compressor associated with the refrigerant system. At the same time, a portion of refrigerant that has been at least partially expanded in the expander is injected into the compression process to reduce the discharge temperature of the main refrigerant flow compressed in the compressor. In the prior art, the injected refrigerant was diverted from the location upstream of the expansion device, thus the diverted refrigerant was not expanded (even partially, through the expander), therefore less expansion could be recovered from the expansion process in the prior art refrigerant systems then in this invention.

In one disclosed embodiment, a portion of refrigerant is taken from an intermediate point in the expansion process in the expander and returned to a suction line leading to a single-stage or multi-stage compressor. In another embodiment, a portion of refrigerant is tapped from an intermediate point in the expansion process in the expander and returned to an intermediate point in the compression process that can be located inside one of the compression stages or in between compression stages.

In yet another embodiment, a portion of refrigerant is taken downstream of the expander and injected into compressor suction. In all cases, an evaporator is bypassed by this portion of injected refrigerant.

In still another disclosed embodiment, a portion of refrigerant is tapped upstream of the expander and injected into the compressor suction or into an intermediate point in the compression process, either inside one of the compression stages or in between the compression stages. Although a single tap point and a single injection point are associated with each embodiment, a combination of the above tap and injection locations is feasible and within the scope of invention.

In all cases considered above, the refrigerant injected into the compression process is at a lower temperature and, in many cases, is a two-phase mixture. Thus, the refrigerant can cool the compressor elements as well as the main flow of compressed refrigerant vapor. The refrigerant injection cooling feature is even more important for high-pressure refrigerant systems, and specifically for refrigerant systems operating in a transcritical cycle, such as $CO_2$ refrigerant systems, that operate at higher pressures and higher pressure ratios, promoting higher discharge temperatures. Additionally, a less efficient transcritical cycle requires even higher discharge pressures or other means of performance enhancement, such as, for instance, a liquid-suction heat exchanger, both further increasing refrigerant discharge temperatures. Specifically, $CO_2$ refrigerant has a higher value of a polytropic exponent, also undesirably affecting the discharge temperature. On the other hand, in the transcritical cycle, pressure and temperature are independent from each other, so discharge temperature reduction may find additional benefits of performance optimization, operational envelope extension and reliability improvement.

In other features, a refrigerant flow control device, such as a valve, may be incorporated onto the refrigerant return line, and can be controlled to achieve desired conditions in the compression process. As an example, the amount of injected refrigerant can be controlled to achieve a desired discharge temperature, discharge superheat, suction superheat, etc. As an example, the valve may be an on/off valve or may be controlled by one of pulsation or modulation techniques, or it can be a valve with an adjustable opening to control the amount of injected refrigerant based on measured operational characteristics of a refrigerant system (such as, for example, a discharge temperature or suction superheat). Again, a worker in this art would recognize how much refrigerant to inject, and when it would be desirable to do so. It is the use of the expander in combination with the refrigerant injection cooling that is inventive here. These and other features of the present invention can be best understood from the following specification and drawings, the following of which is a brief description.

DETAILED DESCRIPTION OF THE PREFERRED EMBODIMENTS

Figure 1:
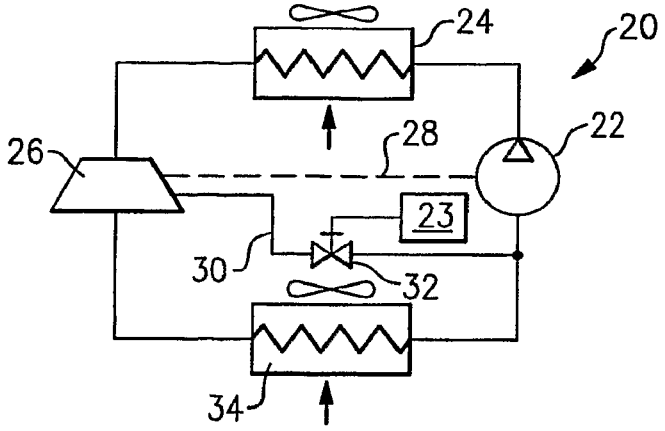
FIG. 1 is shows a first schematic.

FIG. 1 shows a refrigerant system 20 incorporating a compressor 22, which compresses a refrigerant and delivers it to a condenser (in subcritical applications) or a gas cooler (in transcritical applications) 24. Downstream of the condenser or gas cooler 24, the refrigerant passes though an expander 26. As is known, the expander may operate like a turbine, receiving the compressed refrigerant to drive the expander 26 rotor. Other expander types, such as a piston expander (a free-piston type or a linked-piston type), a scroll expander, and a screw expander, are also known in the art. In the expander 26, the refrigerant expands from a higher pressure to a lower pressure, follows a more efficient isentropic (in comparison to isenthalpic) expansion process and provides an opportunity for energy recovery from this expansion process. A power supply connection 28 is shown schematically in FIG. 1, and may be a shaft extended between the expander 26 and the compressor 22 to assist in driving the compressor 22 by recovering at least a portion of energy from the expansion process. Other means of energy recovery, rather than direct usage of mechanical power by a shaft or gearbox connection, such as, for instance, conversion to electric energy, are also known in the art. It should be understood that the compressor 22 can be a multistage compressor, where the stages can be connected in series or in parallel. Alternatively, the expander 26 can drive other components that are part of the refrigerant system 20 (fans, auxiliary pumps, etc.), or it can drive other components external to the refrigerant system 20. The expander 26 may only assist in driving the compressor 22, or may fully drive a secondary compressor, in a refrigerant system that incorporates a main compressor and a secondary compressor. In any case, by recovering this expansion process energy, the performance (efficiency and capacity) of the refrigerant system 20 is enhanced. The details of the expander are not shown, as they may be as known in the art. In the embodiment, a tap port is formed in a housing for the expander 26 to tap at least a portion of the at least partially expanded refrigerant into the return line 30, when desired. Otherwise, the expander operates as known in the art.

Downstream of the expander 26, the refrigerant passes through an evaporator 34, and then returns to the compressor 22.

The invention incorporates the refrigerant return line 30 that returns at least a portion of partially expanded refrigerant (in this embodiment) through a control valve 32, to a suction line leading to the compressor 22. This returned refrigerant is at a lower temperature than the refrigerant flowing to the compressor 22 from the evaporator 34. Various benefits from supplying this colder refrigerant could include reducing the temperature of the refrigerant leaving and/or entering the compressor 22 as well as provide cooling to the elements of the compressor 22. Further, by controlling the amount of refrigerant passing through the control valve 32, these temperatures can be tailored as desired.

A control 23 operates the control valve 32 to control the amount of returned refrigerant to adjust desired operational characteristics, such as, for instance, discharge temperature, suction superheat and discharge superheat, for the refrigerant system 20. The control valve 32 may be provided with a pulse width modulation control such that it can be rapidly opened and closed by the control 23 to exactly tailor the amount of injected refrigerant. Pulse width modulation controls for valves are known, however, they have not been incorporated into a refrigerant system 20 having both the expander 26 and the cooling refrigerant return line 30. The control valve 32 can also have an adjustable opening to precisely meter the amount of injected refrigerant as desired.

Furthermore, as mentioned above, since the partially expanded injection refrigerant is diverted to the compressor from an intermediate location in the expander, the diverted partially expanded refrigerant participates part-way through the expansion process, therefore increasing the amount of energy that can be recovered from the expansion process.

Figure 2:
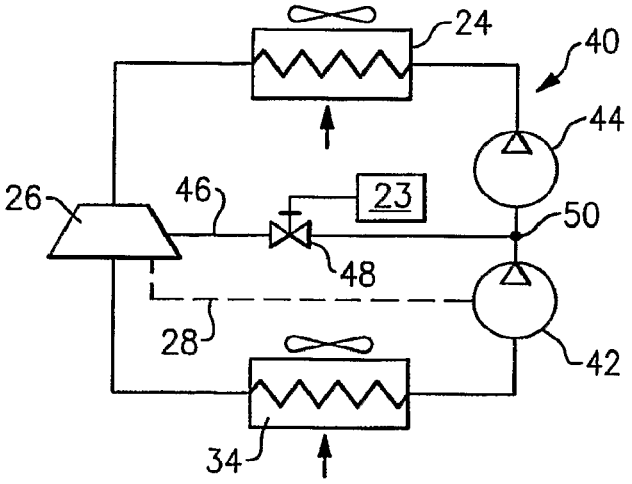
FIG. 2 shows a second schematic.

FIG. 2 shows another embodiment 40, wherein there is a two-stage compressor that consists of two compression stages 42 and 44. As known, two compression stages 42 and 44 can be two separate compressor units or two compression stages within the same compressor, as for instance, two banks of cylinders, in the case of a reciprocating compressor. The power supply connection 28 only assists in driving one lower stage compressor 42. It is understood that a higher stage compressor 44 can take advantage of energy recovery from the expander 26 instead. The refrigerant leaving the expander 26 in this embodiment is returned through a return line 46 into an intermediate return point 50 between the compression stages 42 and 44. The return line 46 also has a control valve 48. The control valve 48 would operate similar to the control valve 32. This embodiment is distinct in that the return point 50 for the refrigerant return line 46 is at an intermediate location between the two compression stages 42 and 44 of the multi-stage compressor system. The function of this refrigerant system would be similar to the FIG. 1 embodiment. It has to be noted that more than two sequential compression stages may be employed by a refrigerant system 40, and the injection return point may be located between any of these compression stages.

Figure 3:
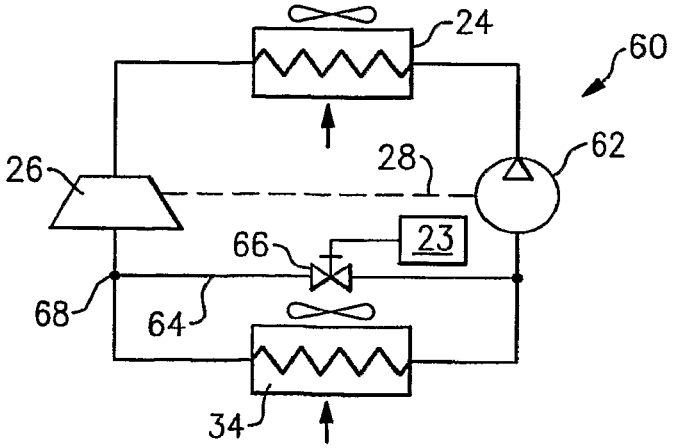
FIG. 3 shows a third schematic.

FIG. 3 shows another embodiment 60, which is similar to the FIG. 1 embodiment. However, a return line 64 is taken from a point 68 downstream of the expander 26. Again, a control valve 66 is controlled such that the amount of refrigerant reaching the compressor 62 is tailored to achieve desired characteristics for the refrigerant system 60. In this arrangement, an orifice or another flow restriction device can be added between the point 68 and entrance to the evaporator 34 to assure that there is sufficient pressure differential to drive the desired amount of injected refrigerant through the refrigerant return line 64. Further, in this embodiment, the injected refrigerant participates in the entire expansion process such as maximum energy amount is recovered from the expansion process, improving performance (capacity and efficiency) of the refrigerant system 60.

While in the embodiments shown in FIGS. 1-3 at least a portion of refrigerant has been tapped from a location where it has been at least partially expanded, in some applications, it may be possible to tap the refrigerant from a location intermediate of the condenser or gas cooler 24 and the expander 26, when little expansion has yet to occur, and re-route this portion of refrigerant to a compressor suction or an intermediate point in the compression process, as was explained hereabove.

Although a single tap point and a single injection point are associated with each embodiment, a combination of the above tap and injection locations is feasible and within the scope of invention. Also, it should be pointed out that, for refrigerant systems employing tandem compressors, refrigerant injection, as well as recovered energy connection, may be provided to all tandem compressors or only to some compressors operating in tandem.

As stated above, the refrigerant injection cooling feature is even more important for high-pressure refrigerant systems, and specifically for refrigerant systems operating in a transcritical cycle, such as $CO_2$ refrigerant systems, that operate at higher pressures and higher pressure ratios, promoting higher discharge temperatures. Additionally, a less efficient transcritical cycle requires even higher discharge pressures or other means of performance enhancement, such as, for instance, a liquid-suction heat exchanger, both further increasing refrigerant discharge temperatures. Specifically, $CO_2$ refrigerant has a higher value of a polytropic exponent, also undesirably affecting the discharge temperature. On the other hand, in the transcritical cycle, pressure and temperature are independent from each other, providing additional flexibility and design opportunities to a refrigerant system designer. Therefore, discharge temperature reduction provided by the refrigerant injection of this invention, along with cycle enhancement opportunities provided by the expander, is more critical and more advantageous in these applications for performance optimization, operational envelope extension and reliability improvement.

Although preferred embodiments of this invention have been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor operable to compress a refrigerant and deliver the refrigerant to a downstream first heat exchanger, refrigerant from said first heat exchanger passing through an expander at which it expands and drives an expander element, and mechanical motion of said expander element being utilized to at least partially drive at least one other component, refrigerant flowing downstream of said expander passing through a second heat exchanger, and from said second heat exchanger back to said compressor through a compressor suction line;

at least a portion of refrigerant tapped from an intermediate point in the expansion process in said expander, and returned through a return line to a location downstream of said second heat exchanger and upstream of said first heat exchanger;

said returned refrigerant has been at least partially expanded in said expander; and a flow control device placed in said return line, said flow control device being operable to control the amount of returned refrigerant.

2. The refrigerant system as set forth in claim 1, wherein said at least one component is said compressor.

3. The refrigerant system as set forth in claim 1, wherein said returned refrigerant is returned to a suction point upstream of said compressor.

4. The refrigerant system as set forth in claim 1, wherein said returned refrigerant is returned to an intermediate point in said compressor.

5. The refrigerant system as set forth in claim 1, wherein said flow control device is a valve, and said valve is controlled by one of pulse width modulation techniques.

6. The refrigerant system as set forth in claim 1, wherein said compressor incorporates at least two compression stages.

7. A method of operating a refrigerant system comprising the steps of:

(1) providing a compressor compressing a refrigerant and delivering the refrigerant to a downstream first heat exchanger, refrigerant from said first heat exchanger passing through an expander at which it expands and drives an expander element, and mechanical motion of said expander element being utilized to at least partially drive at least one other component, refrigerant flowing downstream of said expander passing through a second heat exchanger, and from said second heat exchanger back to said compressor through a compressor suction line; and (2) tapping at least a portion of refrigerant from an intermediate point in the expansion process in said expander and returning it through a return line to a location downstream of said second heat exchanger and upstream of said first heat exchanger, said returned refrigerant having been at least partially expanded in said expander, and a flow control device placed on said return line, said flow control device controlling the amount of returned refrigerant.

8. The method as set forth in claim 7, wherein said at least one component is said compressor.

9. The method as set forth in claim 7, wherein said returned refrigerant is returned to a suction point upstream of said compressor.

10. The method as set forth in claim 7, wherein said returned refrigerant is returned to an intermediate point in said compressor.

* * * * *